US008646628B2

(12) United States Patent
Martin

(10) Patent No.: US 8,646,628 B2
(45) Date of Patent: Feb. 11, 2014

(54) LIFTING DEVICE

(76) Inventor: Vernon Martin, Osage, IA (US)

( * ) Notice: Subject to any disclaimer, the term of this patent is extended or adjusted under 35 U.S.C. 154(b) by 1176 days.

(21) Appl. No.: 11/944,699

(22) Filed: Nov. 26, 2007

(65) Prior Publication Data

US 2009/0134106 A1 May 28, 2009

(51) Int. Cl.
*B66C 23/72* (2006.01)
*B66F 5/04* (2006.01)

(52) U.S. Cl.
USPC ..... 212/197; 254/4 B

(58) Field of Classification Search
USPC ..... 212/197; 254/4 B
See application file for complete search history.

(56) References Cited

U.S. PATENT DOCUMENTS

| | | | | | |
|---|---|---|---|---|---|
| 219,691 | A | * | 9/1879 | Coudoint-Gougeul | 212/197 |
| 233,159 | A | | 10/1880 | Mooney | |
| 1,316,181 | A | | 9/1919 | Phares | |
| 2,754,087 | A | * | 7/1956 | Johnson | 173/28 |
| 3,549,032 | A | * | 12/1970 | Krause, Jr. | 414/735 |
| 3,647,099 | A | * | 3/1972 | Carriere | 414/634 |
| 3,782,503 | A | * | 1/1974 | Sinclair | 187/226 |
| 4,204,664 | A | * | 5/1980 | Bryan, Jr. | 254/288 |
| 4,310,098 | A | * | 1/1982 | Dirksen | 212/299 |
| 4,449,634 | A | * | 5/1984 | Buzzichelli et al. | 212/196 |
| 4,476,955 | A | * | 10/1984 | Carter | 182/2.8 |
| 4,529,064 | A | | 7/1985 | D'Andrea, Jr. | |
| 4,572,383 | A | | 2/1986 | Mori | |
| 4,867,321 | A | | 9/1989 | Montgon | |
| 4,907,768 | A | * | 3/1990 | Masseron et al. | 248/123.11 |
| 5,203,837 | A | | 4/1993 | Madic et al. | |
| 5,697,757 | A | * | 12/1997 | Lindsay | 414/744.6 |
| 6,494,330 | B1 | * | 12/2002 | Montgon et al. | 212/196 |

FOREIGN PATENT DOCUMENTS

| | | | |
|---|---|---|---|
| DE | 37 38 390 A1 | * | 6/1989 |
| SU | 1217774 | * | 3/1986 |

* cited by examiner

*Primary Examiner* — Michael Mansen
(74) *Attorney, Agent, or Firm* — Zarley Law Firm, P.L.C.

(57) ABSTRACT

A lifting device having a frame, a lifting member supported by the frame, and a hydraulic pump and motor supported to the frame. The hydraulic pump and motor are operatively connected to the lifting member to raise, lower, extend, and retract the lifting member.

5 Claims, 2 Drawing Sheets

LIFTING DEVICE

BACKGROUND OF THE INVENTION

This invention is directed to a lifting device, and more particularly a lifting device for lifting corrugated grain bin sheets.

When building a grain bin a number of corrugated grain bin sheets are attached together at ground level and then lifted by a jack to allow for assembly of the next row of sheets. The sheets that are assembled for the higher rings weigh approximately 70 lbs., while the sheets for the bottom rings, in order to provide greater structural support, weigh up to 225 pounds. Typically, an installation crew will lift each sheet manually for placement and attachment. In a day's time, an installation crew will lift approximately 35,000 pounds. This lifting not only leads to fatigue and injury, but it also limits a crew's capacity as it is difficult to install bins on consecutive days.

While lifting devices are known in the art, none are known that are capable of handling the necessary load requirements of grain bin sheets, while still fitting through a grain bin opening which measures 44" in height. Therefore, there exists a need in the art for a lifting device that addresses these deficiencies.

An objective of the present invention is to provide a lifting device that is easy to transport within and around a grain bin.

Another objective of the present invention is to provide a lifting device having a hydraulic system that aids in the lifting process.

A still further objective of the present invention is to provide a lifting device with an extendible lifting member.

These and other objectives will become apparent to one skilled in the art based on the following disclosure.

SUMMARY OF THE INVENTION

A lifting device having a frame that supports a hydraulic pump and motor and a lifting member. The lifting member is pivotally and rotatably mounted to the frame and has a main boom that slidably receives an extendible boom and a counterweight boom. The extendible boom and counterweight boom are operatively connected to extend and retract in unison. The hydraulic pump and motor are operatively connected to the lifting member to raise, lower, extend, and retract the lifting member.

DETAILED DESCRIPTION OF THE PREFERRED EMBODIMENT

Figure 1:
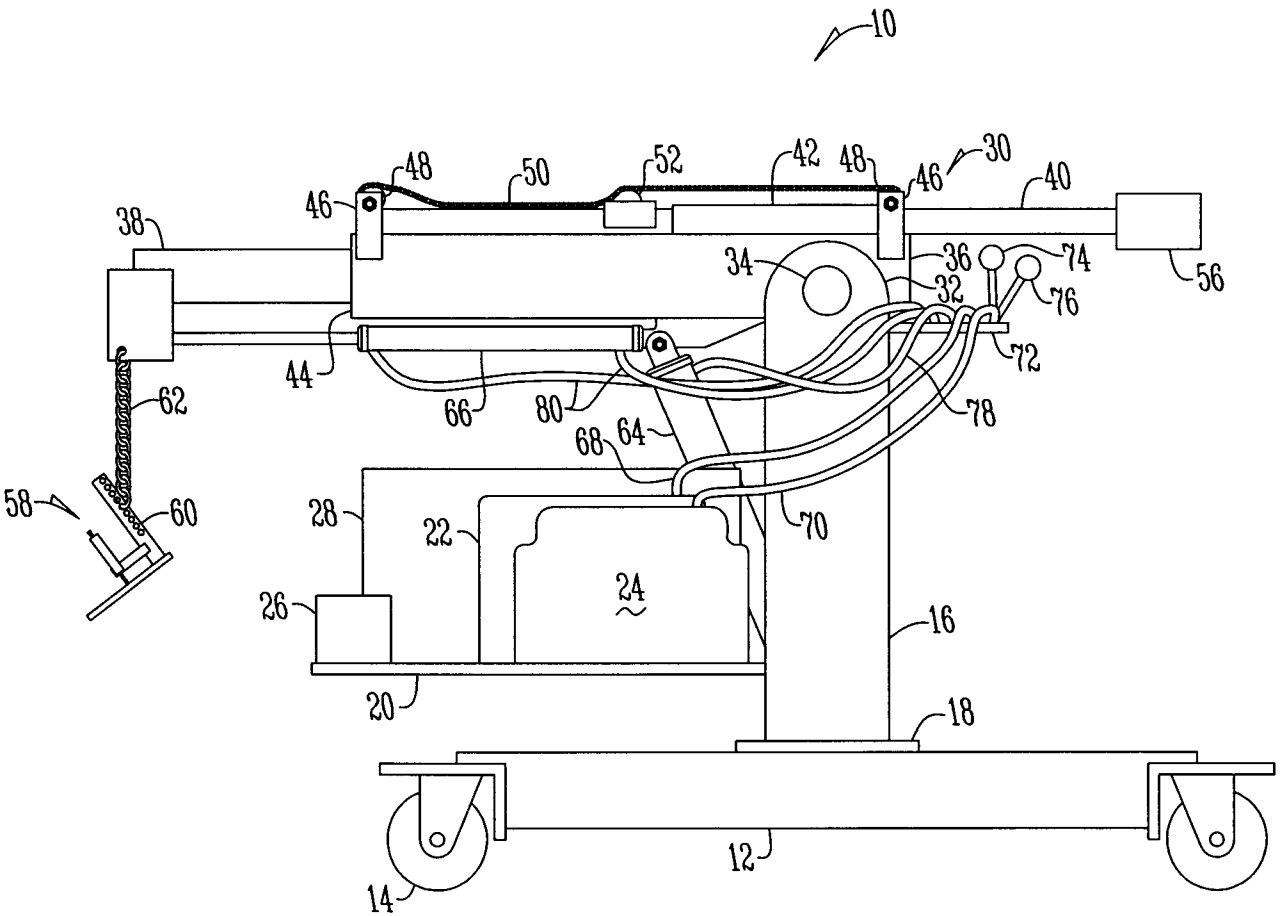
FIG. 1 is a side view of a lifting device.
Figure 2:
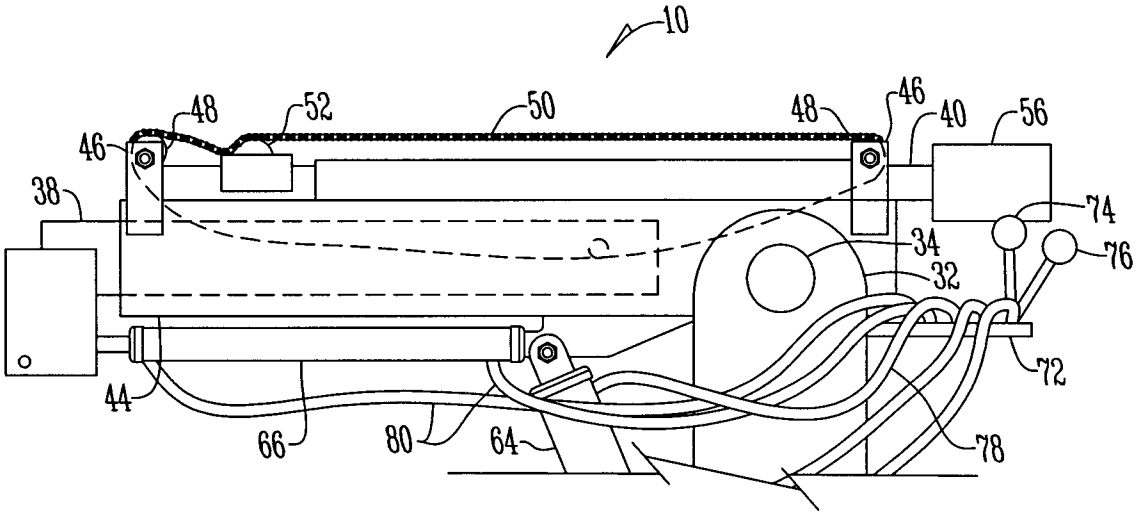
FIG. 2 is an enlarged side view of a lifting member.

The lifting device 10 has a frame 12 that is supported by a plurality of wheels 14. Preferably, the wheels 14 are coaster wheels mounted to each corner of the frame 12 to permit rotation on a small or tight radius. Rotatably mounted to and extending upwardly from the frame 12 is a support shaft 16. The support shaft is pivotally mounted to the frame 12 through a hub 18.

Mounted to the support shaft 16 is a support shelf 20. The shelf 20 supports a hydraulic pump 22 and motor 24 and at least one counterweight 26. An oil tank 28 is also supported by the shelf 20. Alternatively, the oil tank 28 is disposed within the support shaft 16 to conserve space.

A lifting member 30 is pivotably mounted to the top of the support shaft 16. Preferably, the top of the support shaft 16 has a U-joint 32 with a pivot pin 34 that extends through the U-joint 32 and the lifting member 30 to permit the lifting member 30 to pivot about the pivot pin 34.

While the lifting member 30 is of any shape, size, and construction, preferably the lifting member is comprised of a main boom 36, an extendible boom 38, and a counterweight boom 40 that are slidably connected to one another. For example, the main boom 36 is pivotally connected to the support shaft 16. The main boom 36 has a first hollow guide 42 that slidably receives the counterweight boom 40, and a second hollow guide 44 that slidably receives the extendible boom 38. At both ends of the main boom 38 are upwardly extending flanges 46 that support rotatable pulleys 48 therebetween.

Mounted about the pulleys 48 is a continuous chain 50. The chain 50 is connected to the counterweight boom 40 at a first connection point 52. The chain 50 is connected to the extendible boom 38 at a second connection point 54. Through this connection, as boom 38 is extended away from the stationary main boom 36 the chain 50 rotates about pulleys 48. The rotation of the chain is initiated by connection point 54 which moves in conjunction with boom 38. As connection point 54 moves in one direction, connection point 52 moves in an opposite direction. The movement of connection point 52 caused the counterweight boom 40 to move in the same direction a connection point 52. Thus, when boom 38 is extended away from main boom 36, the counterweight boom 40 will also extend away from main boom 36. When boom 38 is retracted toward the main boom 36, the chain rotates in the opposite direction which causes counterweight boom 40 to retract toward main boom 36.

The counterweight boom 40 has at least one counterweight 56 at the end. Preferably, additional counterweights 56 are added based on the load to be lifted. The extendible boom 38 has a connecting member 58 at the end. The connecting member 58 is of any type, shape, and size, but preferably is a spring loaded pin 60 that is attached to boom 38 by a chain/cable 62. Specifically, in a preferred embodiment the connecting member 58 is used to accommodate corrugated grain bin sheets of any size, shape or curve. The spring loaded pin is lifted such that a sheet may be slid underneath the pin and secured thereto. Then, in order to accommodate different and larger diameter sheets a plurality of openings are formed within a bar of the loaded pin 60 such that the chain/cable 62 can be adjusted to help account for the diameter of the sheet. Specifically, depending on the size different openings are used in order to account for the differing diameter sheets in order to facilitate hanging the sheet straight during construction.

To raise and lower, as well as extend and retract the lifting member 30, a pair of cylinders 64, 66 are connected to the lifting member 30. The first cylinder 64 is connected to the hub 18 at one end, and operatively connected to the main boom 36 at the other end. The second cylinder 66 is operatively connected to the main boom 36 at one end, and operatively connected to the extendible boom 38 at the opposite end. Feed lines 68, 70 are connected to the pump 22 and motor 24 at one end and to a valve body 72 at the opposite end. The valve body 72 is mounted to the main boom 36 and has a lifting control lever 74, and an extension control lever 76. The lifting control lever 74 is connected to a pair of feed lines 78 that extend to and are connected to opposite ends of cylinder 64. The extension control lever 76 is connected to a pair of feed lines 80 that extend to and are connected to cylinder 66. As the levers 74 and 76 are activated, the pressure within lines

78 and 80 are adjusted to either extend or contract cylinders 64 and 66. Thus, activation of lifting control lever 74 extends or contracts cylinder 64 causing the lifting member 30 to be raised or lowered. Activation of lever 76 extends or retracts cylinder 66 causing lifting member to extend or retract.

Thus, a lifting device has been disclosed that, at the very least meets all of the stated objectives.

What is claimed is:

1. A lifting device, comprising:

an extendible lifting member pivotally mounted to a frame;

a hydraulic pump and motor supported by the frame;

wherein the hydraulic pump and motor are operatively connected to the lifting member to raise, lower, extend, and retract the lifting member; and wherein the lifting member includes a main boom that has a first hollow guide that slidably receives a counterweight boom and a second hollow guide that slidably receives an extendible boom.

2. The device of claim 1 wherein the frame is supported by a plurality of wheels.

3. The device of claim 1 further comprising a continuous chain mounted about pulleys supported by the main boom, wherein the chain is connected to the counterweight boom at a first connection point and the chain is connected to the extendible boom at a second connection point.

4. The device of claim 1 further comprising a cylinder operatively connected to the pump and motor to raise and lower the lifting member.

5. The device of claim 1 further comprising a cylinder operatively connected to the pump and motor to extend and retract the lifting member.

* * * * *